US006144146A

United States Patent [19]

Cserteg et al.

[11] Patent Number: 6,144,146

[45] **Date of Patent: *Nov. 7, 2000**

[54] HEAT INSULATION FOR SINGLE-ENDED DISCHARGE LAMP

[75] Inventors: Erzsébet Cserteg; József Fülöp; Ferenc Lantos, all of Budapest; Sándor Lukács, Veróce; József Tókés, Budapest; Zoltán Vámos, Budapest; István Würsching, Budapest, all of Hungary

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/987,450

[22] Filed: Dec. 9, 1997

[30] Foreign Application Priority Data

Dec. 20, 1996 [HU] Hungary ..... 9603566

[51] Int. Cl.[7] ..... H01J 5/48

[52] U.S. Cl. ..... 313/318.01; 313/318.02; 313/493; 313/634; 313/43

[58] Field of Search ..... 313/318.01, 318.02, 313/493, 634, 43; 315/58

[56] References Cited

U.S. PATENT DOCUMENTS

| | | | |
|---|---|---|---|
| 2,004,564 | 6/1935 | Bol | 313/318.02 |
| 2,009,220 | 7/1935 | Bol | 313/318.02 |
| 4,503,358 | 3/1985 | Kamei et al. | 315/58 |
| 5,629,581 | 5/1997 | Belle et al. | 313/318.12 |
| 5,691,598 | 11/1997 | Belle et al. | 313/493 |

*Primary Examiner*—Ashok Patel

*Attorney, Agent, or Firm*—Fay, Sharpe, Fagan, Minnich & McKee, LLP

[57] ABSTRACT

The invention relates to a single-ended discharge lamp the light source of which is a discharge tube consisting of at least two tube legs, the said single-ended discharge lamp has a cap part for mechanical and electrical connection to a lampholder, the cap part is, on its side being closer to the discharge tubes, bordered by a separator wall separating it from the space of the light source. According to the invention, cavities (24) accepting the ends of the tube legs are formed in the separator wall (20), and openings (26) for passing inleads are formed at the bottom of the cavities (24) at the places of current feedthroughs.

22 Claims, 3 Drawing Sheets

HEAT INSULATION FOR SINGLE-ENDED DISCHARGE LAMP

Figure 1:
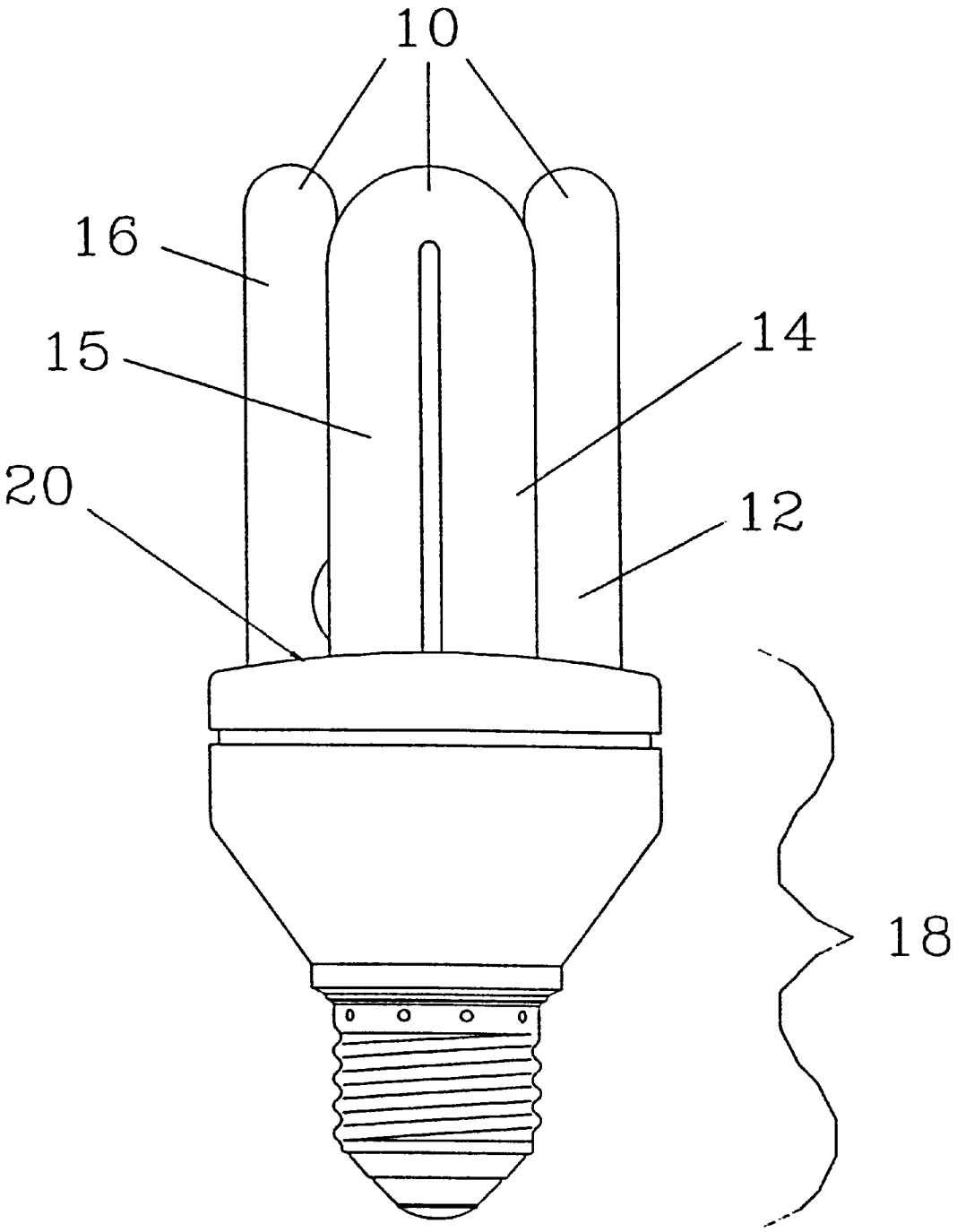

The subject of the invention is a single-ended discharge lamp having a light source and a cap part connecting to a lampholder mechanically and electrically. The invention relates to the heat insulation between the light source and the inner space of the cap part.

There is a widespread knowledge about this kind of discharge lamps. e.g., in a patent application No. P 94 03360 disclosed with No. T/73090 in the Szabadalmi Közlöny és Védjegyértesitö (Hungarian Patent and Trademark Bulletin), No. 6, 1996, a single-ended discharge lamp is described in which openings for passing the legs of the discharge tube are formed in a separator wall separating the cap part from the space of the light source. The legs of the discharge tube pass through these openings and protrude into the space of the cap part to a small extent. The portions of the legs protruding into the space of the cap part are fixed to the separator wall, which also serves as a tube support, by means of a bonding material or an adhesive. An electronic ballast and a starting circuit which are known in themselves and may also comprise several semiconductor parts may also be placed in this space of the cap part.

This solution has the disadvantage that the tube legs of the discharge tube protruding into the tube support to a small extent conduct a part of the heat produced in them into the space of the cap part, thus heat the parts of the ballast circuit. In addition to the conducted heat, radiated heat and light also reach the inside of the cap part which contributes to the heating of parts during operation and the light getting into the cap part causes some loss of illumination and is responsible for a reduction of the luminous efficiency of the lamp.

We have set ourselves the objective with this invention to improve the discharge lamp outlined above in the way that a better heat insulation is provided between the space of the light source and the inner space of the cap part to reduce the extent of heating of the cap part or the ballast circuit parts being optionally inside the cap part. At the same time, the luminous efficiency of the lamp can be enhanced by adding the light emitted towards the cap part to the useful light emission.

According to the invention, the objective set was achieved with a discharge lamp outlined in the introduction by providing cavities in the separator wall which cavities fit to and accept the ends of the tube legs, and the bottoms of the said cavities have openings for passing the inleads at the places of current feedthrough.

This solution has the advantage that the tube legs of the discharge tube protrude into the cavities formed in the separator wall and not into the inner space of the cap part. Owing to this, the discharge tube is separated from the inner space of the cap part, practically no heat will be radiated into it, and also heat conduction will only take place through the separator wall made of an insulator material which means a significantly smaller extent of heat conduction.

The openings for passing the inleads at the places of current feedthrough at the bottom of the cavities have small cross-sections which allows only an insignificant extent of heat convection to occur along the inleads.

In the event that the discharge tube also has tube legs provided with exhaust tube(s) at their ends close to the separator wall, openings for passing the exhaust tube(s) are formed in the bottom of the cavities. Although the exhaust tube(s) will conduct only a small amount of heat into the inner space of the cap, the opening(s) for passing the exhaust tube(s) is (are) closed with cover(s) fitting to the shape of and surrounding the exhaust tube and protruding into the space of the cap part in accordance with a further preferred embodiment of our invention. This results in an additional improvement of heat insulation of the cap part.

In a possible embodiment, the opening(s) for passing the exhaust tube(s) and the openings for passing the inleads are formed in the bottom of one and the same cavity.

In a further possible embodiment, the ends of the tube legs are fixed in the cavities by means of a bonding material or adhesive.

In order to enhance luminous efficiency, at least the surface of that side of the separator wall closer to the light source, is light reflecting.

Figure 2:
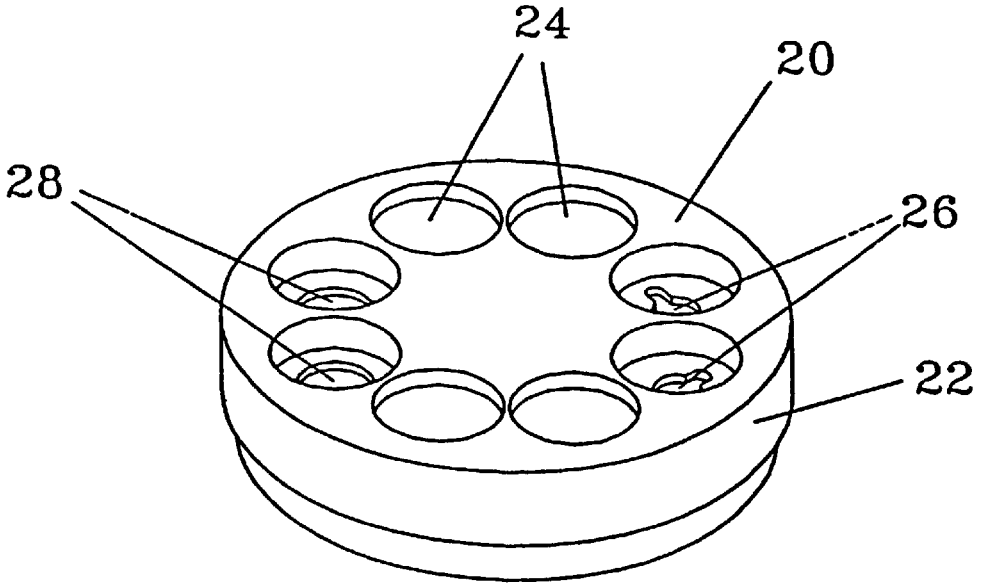
Figure 3:
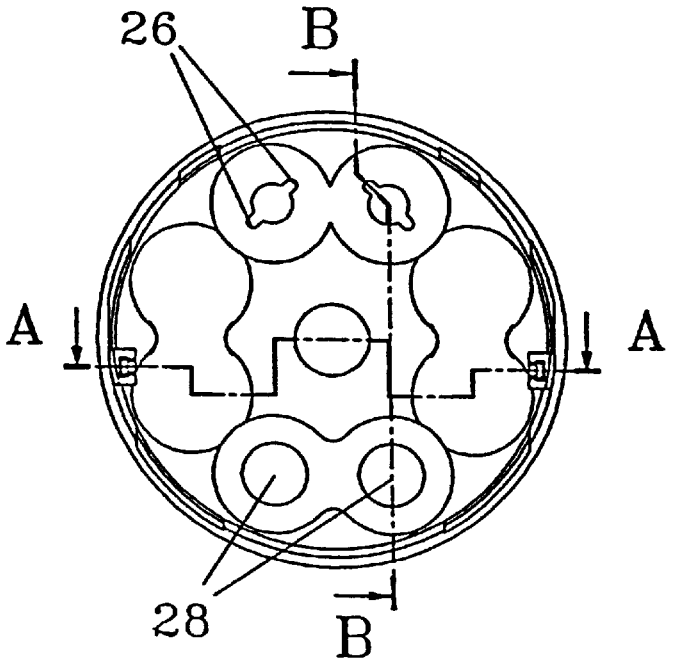
Figure 4:
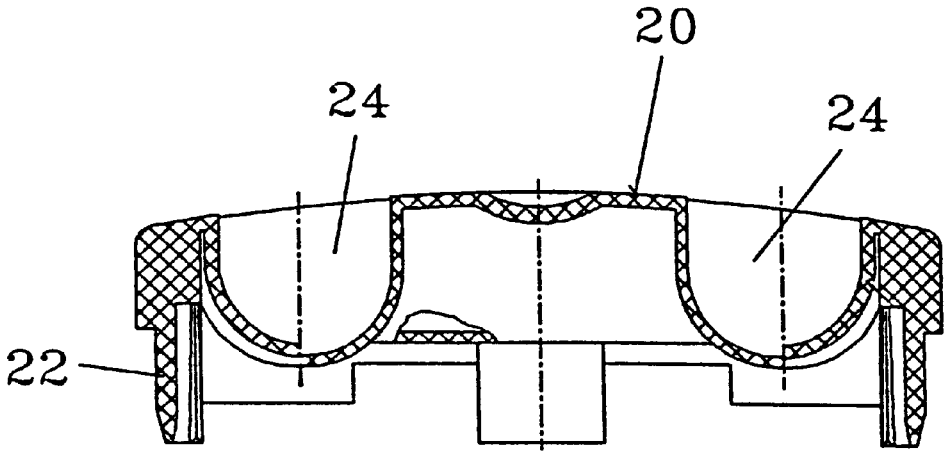
Figure 5:
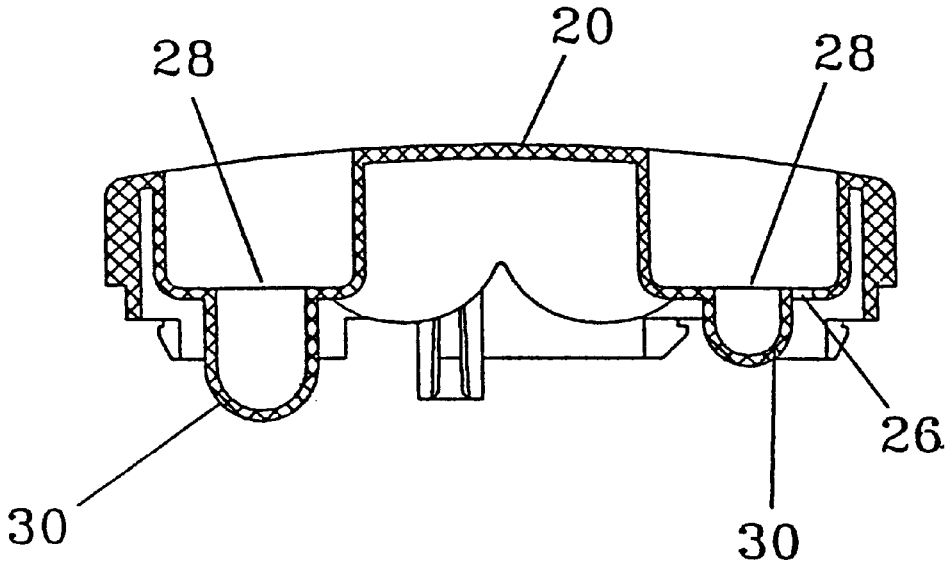

In the following, the discharge lamp according to the invention will be described in more details by means of an example of an embodiment also illustrated in the attached drawing figures where FIG. 1 is a side view of a compact discharge lamp, FIG. 2 is a perspective drawing of the separator wall separating the space of the light source from the cap part, FIG. 3 is the bottom view of the separator wall viewed from the cap part, FIG. 4 is the section of the separator wall shown in FIG. 3, taken along the broken line A—A and FIG. 5 is the section of a further possible embodiment of the separator wall, taken along the line B—B shown in FIG. 3.

FIG. 1 shows a compact discharge lamp known in itself and having a discharge tube 10 consisting of tube legs 12, 14, 15, 16 in series connection which discharge tube serves as the light source of the lamp. The discharge lamp has eight tube legs of which only four tube legs 12, 14, 15, 16 are seen in the side view of the figure. It is practical to place the tube legs along a circle in top view, thus the longitudinal axis of each of the eight tube legs according to the example are in the vertices of a regular octagon. Of course, discharge tubes consisting of four or six tube legs are also used.

In the lower part of FIG. 1, cap part 18 of the discharge lamp is seen. This cap part 18 is illustrated only schematically. In the example shown, this cap part 18 has a conventional screw part for screwing it into a lampholder to ensure electrical and mechanical connection, and the upper part of the screw part fits to a conical housing, in the inside of which an electronic ballast circuit is placed. This conical housing of the cap part 18 is separated from the space of the light source represented by the discharge tube 10 by a separator wall 20. In the example shown, the discharge tube 10 consisting of the tube legs 12, 14, 15, 16 is fixed mechanically by this separator wall 20.

Perspective view of the separator wall 20, its bottom view from the cap part 18, and its section taken over the broken line A—A are shown in FIG. 2, FIG. 3, and FIG. 4, respectively. A circular rim 22 extending downward from and in essential perpendicularly to the separator wall 20 is placed over the perimeter of the said separator wall 20, for a mechanical joint between the separator wall 20 and the housing of the cap part 18. This rim 22 may have guides, slots, snap-in shoulders, etc. for fitting and fixing it to the housing.

The separator wall 20 of a compact discharge lamp having a discharge tube 10 consisting of eight tube legs is seen in this example. In contrast to the known solution, in the separator wall according to the invention, the end of each tube leg 12, 14, 15, 16 is placed in a cup-shaped cavity 24, the shape and size of which fit to the end of the corresponding tube leg. In accordance with this, the bottom of the cavities 24 has usually the shape of a hemisphere. The tube legs 12, 14, 15, 16 of the discharge tube 10 may be fixed by means of an adhesive placed in one or more cavities 24 of the separator wall 20.

The inner discharge spaces of the tube legs 12, 14, 15, 16 are connected in series with each other by means of bridging portions. Current inleads pass through the ends of the two outer tube legs being closer to the cap part to supply energy required by the discharge at the ends of the series connected spaces. In order that the current inleads can pass through the separator wall 20, an opening 26 is provided at the bottom of each cavity 24 belonging to the corresponding two tube legs. In the event that an adhesive for fixing the tube legs 12, 14, 15, 16 is brought also in these cavities 24, this adhesive will surround also the current inleads and can also close the opening 26.

In order to provide an appropriate fill in the discharge space, an exhaust tube is placed at the ends of some tube legs being closer to the cap part 18. This exhaust tube is tipped off to be sealed after exhausting the air from and adding the appropriate fill to the discharge space. The exhaust tube may be placed at the end of the tube legs having the electrodes for the discharge, adjacent to the current inleads or at the ends of separate tube legs. These tipped-off exhaust tube studs protrude to a small extent downward from the tube legs, therefore opening(s) 28 is (are) formed at the bottom of the cavity (cavities) 24 for these studs. In the event that an adhesive for fixing the tube legs is also brought in these cavities 24, this adhesive will also surround the current inleads and close the opening 28.

In FIG. 5 which is a section taken along the line B—B shown in FIG. 3, it is seen that the separator wall 20 is provided with covers 30 connecting to the openings 28. These covers 30 protrude into the inner space of the cap part 18 and their shape and size fit to those of the exhaust tube stud protruding from the end of the corresponding tube leg, and the covers 30 surround the exhaust tube studs. This results in that the heat conducted by the exhaust tube studs is insulated from the inner space of the cap part 18 by the covers 30.

The separator wall 20 is preferably made of an insulator material. This is preferable for two reasons: firstly, a better heat insulation can be provided for the electronic ballast circuit and secondly, no separate electric isolation is needed at the current feedthroughs. It is practical if the insulator material is a plastic that withstands the operating temperature of the lamp without deformation.

It is preferable if at least the side of the separator wall 20 being closer to the light source has a light reflecting surface. This is preferable for two reasons: firstly, the light reflecting surface reflects the heat radiation leaving the discharge tube during operation, thereby increasing the heat insulation for the parts of the electronic ballast circuit placed in the housing 18, and secondly, it also reflects the light rays reaching it, thereby enhancing the luminous efficiency of the lamp. In accordance with this, the separator wall may be made of a light reflecting white material. A metal layer applied to the side of the separator wall being closer to the light source is also conceivable.

We claim:

1. A single-ended discharge lamp comprising a discharge light source having at least two tube legs, the said single-ended discharge lamp having a cap part for mechanical and electrical connection to a lampholder, the cap part having a first side closer to the discharge tubes, bordered by a separator wall separating it from the light source, the separator wall including cavities (24) accepting the ends of the tube legs (12, 14, 15, 16) and openings (26) formed at the bottom of the cavities (24) for passing inleads therethrough.

2. The discharge lamp according to claim 1 comprising additional opening(s) (28) for passing exhaust tube(s) at the bottom of the cavities (24).

3. The discharge lamp according to claim 2 characterized in that the opening(s) (28) for passing exhaust tube(s) and openings (26) for passing inleads are formed at the bottom of one and the same cavity (24).

4. The discharge lamp according to claim 2 wherein each opening (28) for passing an exhaust tube is closed by a cover (30) protruding into the space of the cap part (18), which cover surrounds the exhaust tube and fits to the shape thereof.

5. The discharge lamp according to claim 1 wherein each opening (28) for passing an exhaust tube is closed by a cover (30) protruding into the space of the cap part (18), which cover surrounds the exhaust tube and fits to the shape thereof.

6. The discharge lamp according to claim 1 wherein the ends of the tube legs (12, 14, 15, 16) are fixed in the cavities (24).

7. The discharge lamp according to claim 1 wherein the ends of the tube legs (12, 14, 15, 16) are fixed in the cavities (24) by means of a bonding material.

8. The discharge lamp according to claim 1 wherein the separator wall (20) is made of an insulator material.

9. The discharge lamp according to claim 1 wherein a first side of the separator wall (20) has a light reflecting surface.

10. A compact discharge lamp comprising:

a discharge tube having multiple tube legs with first terminal ends;

a cap part having a first end that mechanically and electrically connects the lamp to an associated power source;

a separator wall interposed between the discharge tube and the cap part for receiving the first terminal ends of the discharge tube, wherein the separator wall having cavities and openings formed in bottoms of the cavities and dimensioned for closely receiving inleads therethrough.

11. The discharge lamp according to claim 10 comprising additional opening(s) for passing exhaust tube(s) at the bottom of the cavities.

12. The discharge lamp according to claim 11 characterized in that the openings(s) for passing exhaust tube(s) and openings for passing inleads are formed at the bottom of one and the same cavity.

13. The discharge lamp according to claim 11 wherein each opening for passing an exhaust tube is closed by a cover protruding into the space of the cap part, which cover surrounds the exhaust tube and fits to the shape thereof.

14. The discharge lamp according to claim 10 wherein each opening for passing an exhaust tube is closed by a cover protruding into the space of the cap part, which cover surrounds the exhaust tube and fits to the shape thereof.

15. The discharge lamp according to claim 10 wherein the ends of the tube legs are fixed in the cavities.

16. The discharge lamp according to claim 10 wherein the ends of the tube legs are fixed in the cavities by means of a bonding material.

17. The discharge lamp according to claim 10 wherein the separator wall is made of an insulator material.

18. The discharge lamp according to claim 10 wherein a first side of the separator wall has a light reflecting surface.

19. The discharge lamp according to claim 1 wherein the cavities have a hemispherical contour that conforms to the shape of the tube leg ends.

20. The discharge lamp according to claim 1 wherein the cavities are dimensioned to receive an outer diameter of the tube legs and the openings having a dimension substantially less than the cavity dimensions for receiving the inleads therethrough.

21. The discharge lamp according to claim 10 wherein the cavities have a hemispherical contour that conforms to the shape of the tube leg ends.

22. The discharge lamp according to claim 10 wherein the cavities are dimensioned to receive an outer diameter of the tube legs and the openings having a dimension substantially less than the cavity dimensions for receiving the inleads therethrough. have a hemispherical contour that conforms to the shape of the tube leg ends. the ends of the tube legs are fixed in the cavities.

* * * * *

UNITED STATES PATENT AND TRADEMARK OFFICE

CERTIFICATE OF CORRECTION

PATENT NO. : 6,144,146
DATED : November 7, 2000
INVENTOR(S) : Cserteg, et al.

It is certified that error appears in the above-identified patent and that said Letters Patent is hereby corrected as shown below:

In the Claims:

Column 6,
Lines 10-16, delete "have a hemispherical contour that conforms to the shape of the tube leg ends, the ends of the tube legs are fixed in the cavities"

Signed and Sealed this

Third Day of July, 2001

*Attest:*

Nicholas P. Godici

*Attesting Officer*

NICHOLAS P. GODICI
*Acting Director of the United States Patent and Trademark Office*